US010203178B2

(12) United States Patent
Drake

(10) Patent No.: US 10,203,178 B2
(45) Date of Patent: Feb. 12, 2019

(54) FIREARM CHASSIS WITH INTEGRATED RAIL SYSTEM

(71) Applicant: Drake Associates, Inc., Shelter Island, NY (US)

(72) Inventor: Christopher Drake, Shelter Island, NY (US)

(73) Assignee: Drake Associates, Inc., Vero Beach, FL (US)

( * ) Notice: Subject to any disclaimer, the term of this patent is extended or adjusted under 35 U.S.C. 154(b) by 0 days.

(21) Appl. No.: 15/873,468

(22) Filed: Jan. 17, 2018

(65) Prior Publication Data

US 2018/0202760 A1 Jul. 19, 2018

Related U.S. Application Data

(60) Provisional application No. 62/446,898, filed on Jan. 17, 2017.

(51) Int. Cl.
*F41C 23/16* (2006.01)
*F41A 11/02* (2006.01)

(52) U.S. Cl.
CPC ..... *F41C 23/16* (2013.01); *F41A 11/02* (2013.01)

(58) Field of Classification Search
CPC ..... F41C 23/16
USPC ..... 42/71.01, 72
See application file for complete search history.

(56) References Cited

U.S. PATENT DOCUMENTS

| | | | | |
|---|---|---|---|---|
| 3,011,283 | A * | 12/1961 | Lunn | F41C 23/00 42/71.01 |
| 5,873,189 | A * | 2/1999 | Menke | F41C 23/16 42/71.01 |
| 6,839,998 | B1 * | 1/2005 | Armstrong | F41C 23/00 42/71.01 |
| 2007/0180750 | A1 * | 8/2007 | Al-Mulla | F41C 23/06 42/71.01 |
| 2008/0244951 | A1 * | 10/2008 | Picard | F41A 3/66 42/71.01 |
| 2010/0162608 | A1 * | 7/2010 | McCann | F41C 23/14 42/71.01 |
| 2015/0192384 | A1 * | 7/2015 | Ballard | F41A 9/70 42/49.01 |
| 2016/0313087 | A1 * | 10/2016 | Leasure | F41C 23/16 |
| 2017/0219310 | A1 * | 8/2017 | Jones | F41A 11/02 |

* cited by examiner

*Primary Examiner* — Reginald S Tillman, Jr.
(74) *Attorney, Agent, or Firm* — Carter, DeLuca, Farrell & Schmidt, LLP

(57) ABSTRACT

A chassis for a firearm includes sidewalls, a forearm, and a first rail portion. The sidewalls define a trigger well and a magazine well therebetween. The sidewalls also define a proximal portion of a channel. The forearm is monolithically formed with the chassis and extends distally from the magazine well. The forearm defines a distal portion of the channel which is configured to receive a barrel of a firearm. The first rail portion extends from the forearm adjacent the channel on a first side of the chassis. The first rail portion defines part of a rail system that is configured to securely mount an accessory directly to the chassis.

19 Claims, 4 Drawing Sheets

FIREARM CHASSIS WITH INTEGRATED RAIL SYSTEM

CROSS-REFERENCE TO RELATED APPLICATION

This application claims priority to and benefit of U.S. Provisional Patent Application Ser. No. 62/446,898, filed Jan. 17, 2017, the entire contents of which are hereby incorporated by reference.

BACKGROUND

1. Technical Field

The present disclosure relates to firearms and, more specifically, to a tactical chassis system providing a weapon accessory mount interface, including a mounting rail interface system for use with a firearm.

2. Discussion of Related Art

The modern firearm has evolved to utilize a great deal of accessories in response to user demand to address an abundance of unique situations. Modular rifle systems address this demand by allowing manufacturers to produce standard components of a rifle and allows dealers and end users to customize the rifle system. The major components of a modular rifle system are a stock, a chassis, a barrel, and an action. The chassis is the central component of the modular rifle system and may be integrally formed with the stock. The barrel and action each mount to the chassis.

Modular rifle systems can include a rail interface system that is secured to the chassis. The rail interface system allows components that require precision, such as optics, to be secured to the chassis. Additionally or alternatively, components that provide stability to the modular rifle system can be secured to the chassis by the rail interface system. Accordingly, there is a need for rail interface systems that provide increased precision and/or stability to the modular rifle system.

An important consideration when using a modular rifle system is that certain jurisdictions in the United States restrict the manufacturing, sale, or use of firearms with certain defining features or combinations thereof. Specific jurisdictions limit configurations of one or more components of firearms. One component that is restricted in some jurisdictions is a pistol grip on long guns including rifles and shotguns.

Generally, a pistol grip is connected to the action and/or chassis of the firearm adjacent a trigger guard and orients an end user's grip with respect to the trigger of the firearm for increased stability and maneuverability. A pistol grip can allow for a pistol style grasp in which the web of the trigger hand (between the thumb and index finger) can be placed below the top exposed portion of the trigger while firing. In particular jurisdictions, a pistol grip is a grip that protrudes conspicuously beneath the action of the firearm.

There is a need for grips that provide stability and maneuverability and that are not restricted in most jurisdictions. In particular, there is a need for grips that do not protrude conspicuously beneath the action of the firearm.

SUMMARY

In an aspect of the present disclosure, a chassis for a firearm includes sidewalls, a forearm, and a first rail portion. The sidewalls define a trigger well and a magazine well therebetween. The sidewalls also define a proximal portion of a channel. The forearm is monolithically formed with the chassis and extends distally from the magazine well. The forearm defines a distal portion of the channel which is configured to receive a barrel of a firearm. The first rail portion extends from the forearm adjacent the channel on a first side of the chassis. The first rail portion defines part of a rail system that is configured to securely mount an accessory directly to the chassis. The first rail portion may be monothically formed with the forearm.

In aspect, the forearm includes a second rail portion that extends from the forearm adjacent the channel on a second side of the chassis that is opposite the first side of the chassis such that the channel passes between the first and second rail portions. The first and second rail portions may extend from the forearm such that an upper surface of each of the first and second rail portions is configured to extend above a centerline of a barrel received within the channel. The sidewalls may have an upper surface that is configured to be positioned below a centerline of a barrel received within the channel. The forearm may include a lower surface that defines a lower rail system that is configured to securely mount an accessory directly to the chassis.

In some aspects, the chassis includes a proximal portion that extends proximally from the trigger well. The proximal portion may be configured to receive a stock. The proximal portion may include a fastener that is configured to secure a grip to a lower surface thereof. The proximal portion may be integrally formed with the stock. The stock may be a fixed stock, a folding stock, and/or an adjustable stock.

In another aspect of the present disclosure, a grip for a firearm includes a distal strut, a connector, and a hand grip. The distal strut is configured and dimensioned to flushingly receive a trigger guard of a firearm. The connector extends proximally from the distal strut and is configured to releasably secure to a proximal portion of a chassis. The hand grip extends proximally from the connector. The hand grip has an upper surface that is configured to be spaced apart from and oppose the proximal portion of the chassis and a stock. The hand grip has a lower surface that extends from the connector. A plane defined by the lower surface forms an acute angle with a plane defined by the upper surface. The lower surface is configured to receive non-trigger fingers of a hand.

In aspects, the connector includes a connecting surface having an opening that is configured to receive a fastener therethrough to secure the grip to the chassis.

In another aspect of the present disclosure, a method includes securing a barrel in a channel that is defined by a chassis and securing a first accessory to a first rail system of the chassis. The chassis includes sidewalls that define a proximal portion of the channel and a forearm that defines a distal portion of the channel. The first rail system extends from the forearm on a first side of the channel such that an upper surface of the first rail system is positioned above a centerline of the barrel when the barrel is received within the channel. The first rail system being monolithically formed with the forearm.

In aspects, securing the first accessory includes securing the first accessory to a second rail system of the chassis. The second rail system may extend from the forearm on a second side of the channel such that an upper surface of the second rail system is positioned above the centerline of the barrel when the barrel is received within the channel and the barrel is positioned between the first and second rail portions. The second rail system may be monolithically formed with the forearm.

In some aspects, the method includes securing a second accessory to a lower rail system of the chassis. The lower rail system may be defined in a lower surface of the forearm opposite of the channel.

In certain aspects, the method includes positioning a trigger mechanism in a trigger well defined by the sidewalls and securing a ridgeline grip to a proximal portion of the chassis proximal of the trigger well such that a distal strut of the ridgeline grip receives a portion of a trigger guard of the trigger mechanism. The trigger mechanism also has a trigger which may be partially surrounded by the trigger guard. The ridgeline grip may have a connector that extends proximally from the distal strut and a hand grip that extends proximally from the connector. The hand grip has an upper surface that is spaced apart from and opposed to a proximal portion of the chassis and a lower surface that extends from the connector. The plane is defined by the lower surface that forms an acute angle with a plane defined by the upper surface. The lower surface is configured to receive non-trigger fingers of a hand.

In particular aspects, securing the ridgeline grip includes passing a fastener through the connector of the ridgeline grip and into the proximal portion of the chassis. The method may include securing a stock to the proximal portion of the chassis such that the upper surface of the hand grip opposes a portion of the stock.

Further, to the extent consistent, any of the aspects described herein may be used in conjunction with any or all of the other aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
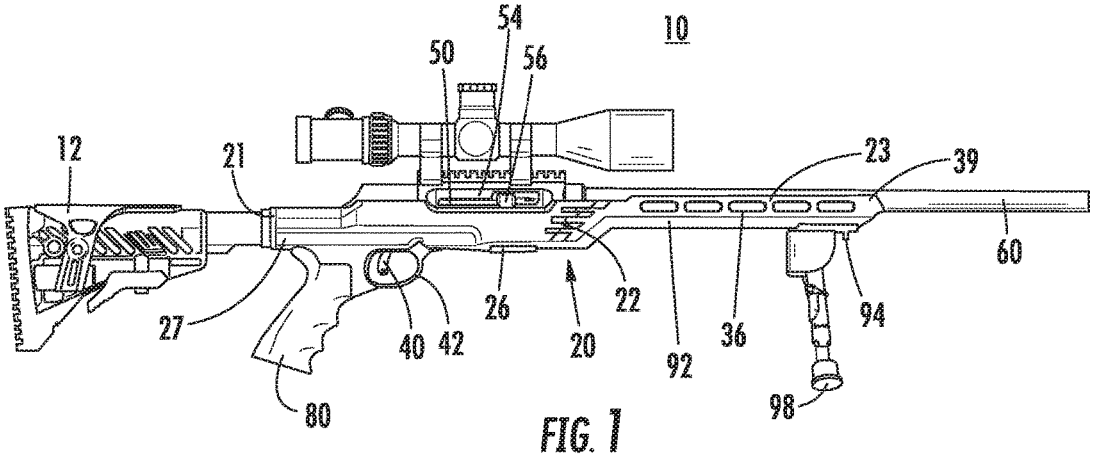
FIG. 1 is a right side view of a firearm provided in accordance with the present disclosure including a barrel, an action, and a tactical chassis system having an integrated rail system.

Embodiments of the present disclosure are now described in detail with reference to the drawings in which like reference numerals designate identical or corresponding elements in each of the several views. Throughout this description, the term "proximal" refers to the portion of the device or component thereof that is closer to a user and the term "distal" refers to the portion of the device or component thereof that is farther from the user.

Detailed herein is a modular rifle system including a tactical chassis. The tactical chassis may include an integrated rail system. The integrated rail system may include a rail interface on the right, left, lower, and/or top surface of the chassis. The tactical chassis may be used with a variety of grips including a pistol grip or a ridgeline grip. The modular rifle system may include a semi-automatic action.

Figure 2:
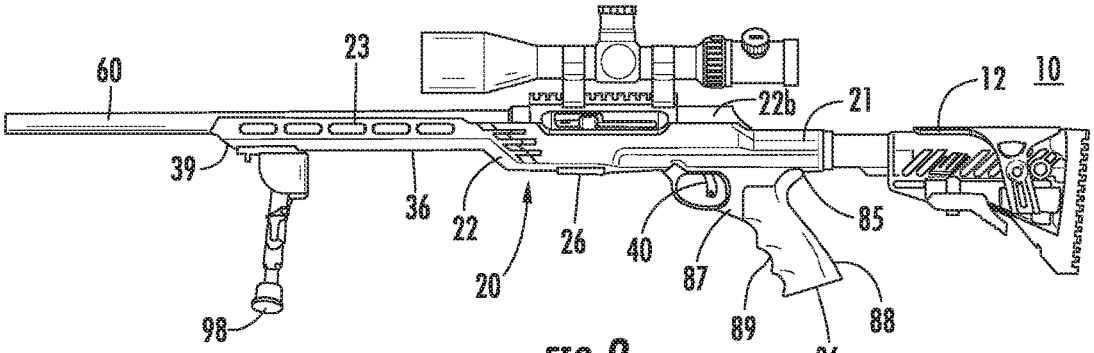
FIG. 2 is a left side view of the firearm in FIG. 1.
Figure 3:
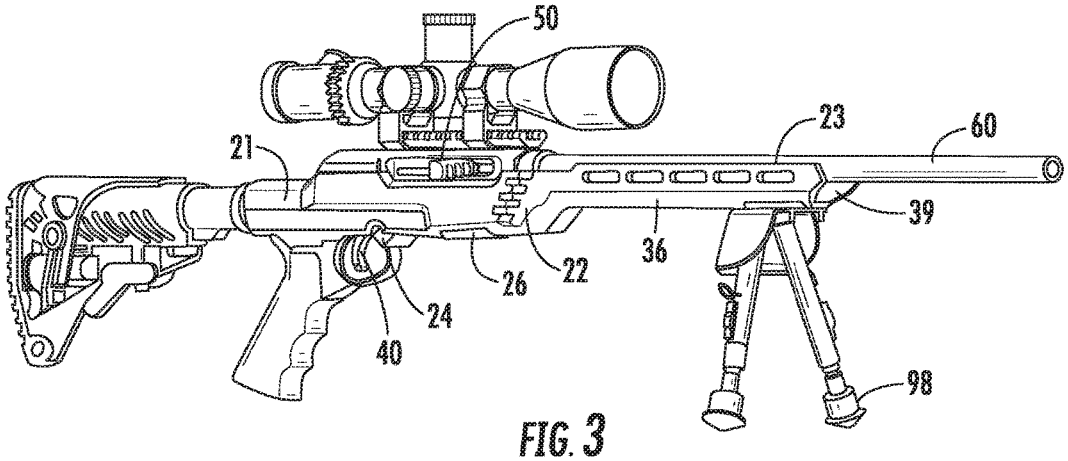
FIG. 3 is a perspective view of the firearm in FIG. 1.

Referring to FIGS. 1-3, a modular rifle system 10 is provided in accordance with the present disclosure and includes a stock 12, a tactical chassis 20, a trigger mechanism 40, an action 50, a barrel 60, and a magazine (not explicitly shown). As shown, the action 50 is a .17 HMR semi-automatic action; however, the action 50 may be a variety of actions including, but not limited to, a .17 HRM action, a .22 LR action, a .22 Magnum action, a .308 action, a .410 action, a rimfire action, a short or long bolt action, a short or long semi-automatic action, a short or long action shotgun action, or a muzzle loader action.

The tactical chassis 20 includes sidewalls 22 that extend from a proximal portion 21 to a distal portion 39. The tactical chassis 20 defines a trigger well 24 (FIGS. 4 and 5) and a magazine well 26 and includes a forearm 36 that extends from the magazine well 26 to the distal portion 39 of the tactical chassis 20. The trigger well 24 receives the trigger mechanism 40 and the magazine well 26 receives a magazine. The magazine may be releasably secured within the magazine well or may be an internal magazine received within the forearm 36 of the tactical chassis 20.

The stock 12 is secured to the proximal portion 21 of the tactical chassis 20. The stock 12 may be integrally formed with or releasably secured to the proximal portion 21 of the tactical chassis 20. As shown, the stock 12 is an adjustable stock; however, the stock 12 may be a fixed stock, a folding stock, or an adjustable folding stock.

Figure 4:
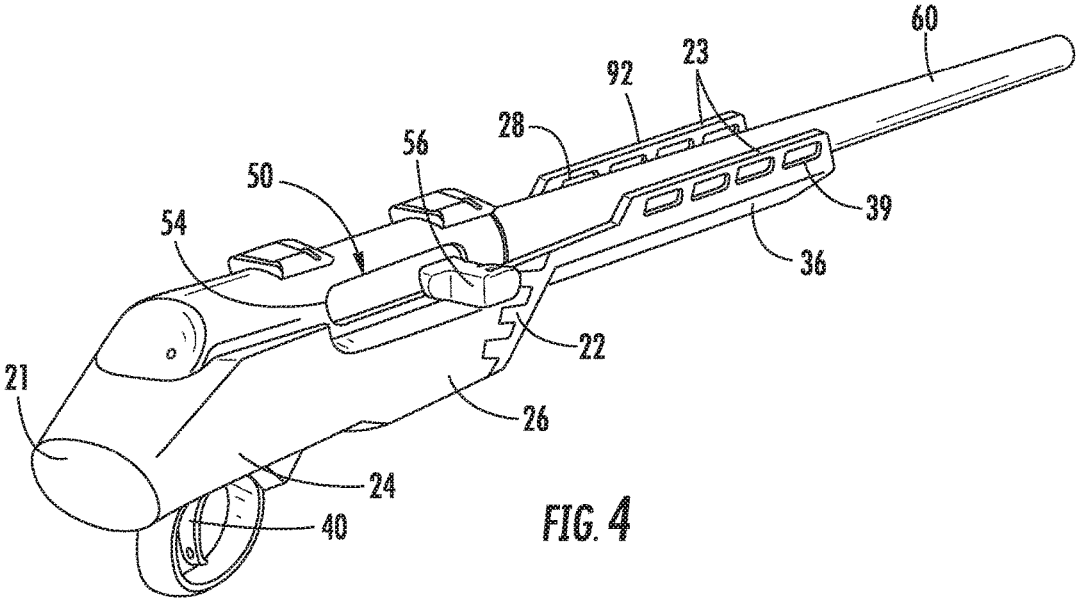
FIG. 4 is an upper back, side perspective view of a portion of the firearm of FIG. 1 illustrating the tactical chassis system, barrel, and action.

Referring now to FIG. 4, the sidewalls 22 of the tactical chassis 20 defines a proximal portion of a channel 28 above the trigger well 24 and the magazine well 26. The channel 28 receives the action 50 and the barrel 60. The proximal portion of the channel 28 cradles about 135° of the action 50 and the barrel 60 such that upper surfaces of the sidewalls 22 are positioned below a centerline of the action 50 and the barrel 60 adjacent the action 50 and the barrel 60.

Figure 5:
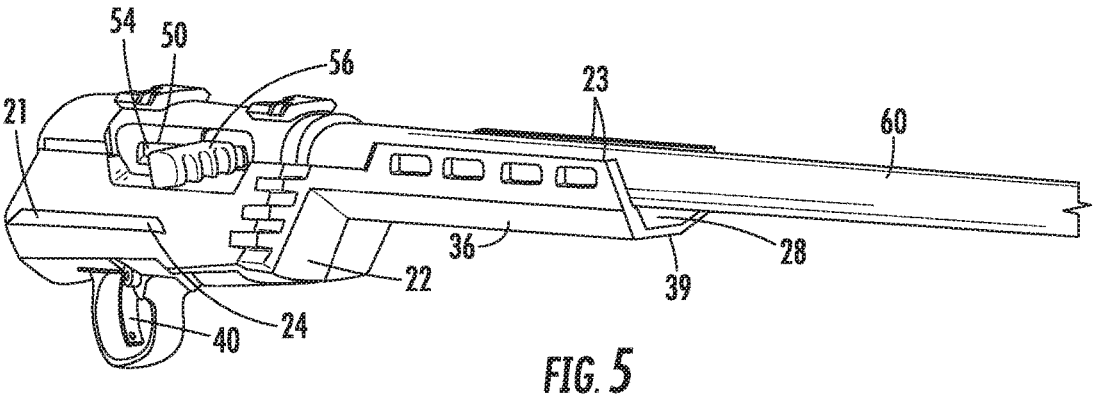
FIG. 5 is a front, side perspective view of the portion of the firearm of FIG. 4.
Figure 6:
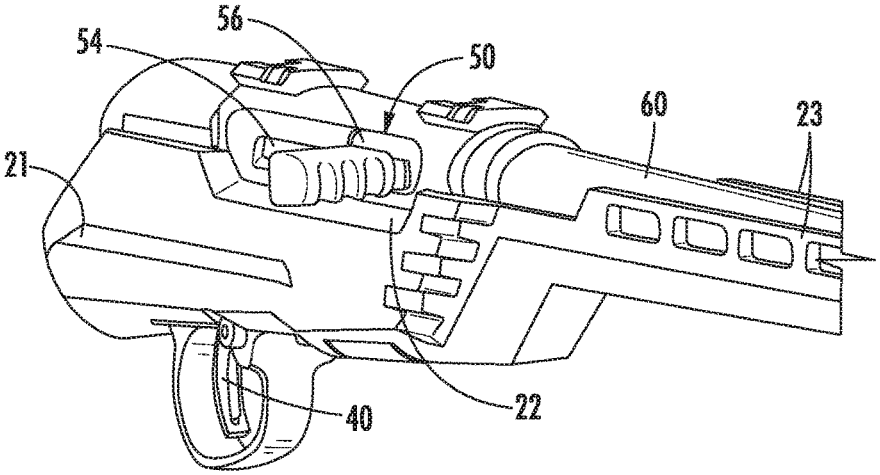
FIG. 6 is an enlarged front, side perspective view of the portion of the firearm of FIG. 4.
Figure 7:
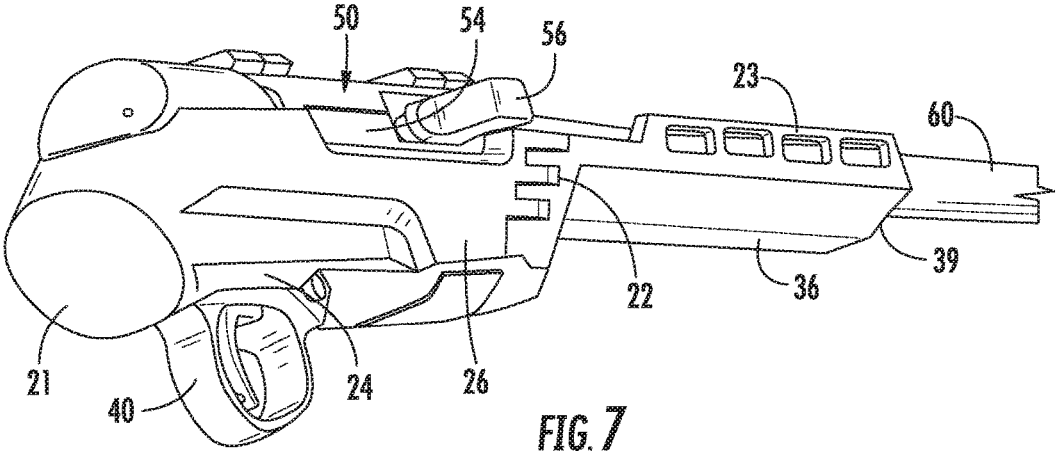
FIG. 7 is a lower back,-side perspective view of the portion of the firearm of FIG. 4.

With reference to FIGS. 4-6, the action 50 includes a slide 54 and defines a chamber 52 (FIG. 6). The slide 54 is slidable within the action 50 between a first configuration (FIG. 6) in which the slide 54 is in an open position to provide access to the chamber 52 and a second configuration (FIG. 4) in which the slide 54 is locked in a closed position such that the chamber 52 of the action 50 is closed. In the closed position, the chamber 52 is closed and the trigger mechanism 40 is actuatable to fire a cartridge (not shown) positioned within the chamber 52. The slide 54 includes a slide arm 56 that extends from and is secured to the slide 54. The slide arm 56 is engagable by an end user to manually move the slide 54 between the closed position and the open position. The slide 54 may be biased towards the closed position. It will be appreciated that when the action 50 is a semi-automatic action, the action 50 will transition the slide 54 from the second configuration to the first configuration upon firing of the cartridge and the bias of the slide 54 will return the slide 54 to the second configuration such that the action 50 is prepared to fire a fresh cartridge loaded into the chamber 52.

Referring now to FIGS. 1-7, the tactical chassis 20 is configured to receive a right-handed action 50; however, it is contemplated that the chassis 20 may receive a left-handed or ambidextrous action. As shown, the action 50 is a right-handed action 50 allowing the chamber 52, the slide 54, and the slide arm 56 to be accessed from the right side of the modular rifle system 10. In the closed position, the slide arm 56 is positioned at a distal end of a slide rail 58 within the action 50 as shown in FIG. 6. To move the slide 54 to the open position, the slide arm 56 is slid proximally along the slide rail 58. When the slide arm 56 reaches a proximal end of the slide rail 58, the action 50 is in a fully open position. As the slide 54 slides to the fully open position, a cartridge (not shown) may be ejected from the chamber 52. In the right-handed configuration, the cartridge is ejected from the right side of the chamber 52. As the slide 54 reaches the fully open position, a lower portion of the chamber 54 is opened to allow a new cartridge from the magazine (not shown) to enter the chamber 52. Alternatively, a new cartridge may be placed directly into the chamber 52 when the slide 54 is in the open position.

When a new cartridge is within the chamber 52, the slide arm 56 is engaged to slide the slide 54 distally towards the closed position. As the slide 54 slides distally along the slide rail 58, the new cartridge is positioned or loaded into the chamber 52. When the slide 54 reaches the closed position, the slide arm 56 is located at the distal end of the slide rail 58. The slide 54 may be biased towards the closed position such that the slide 54 automatically slides distally to load the new cartridge and to close the chamber 52.

Referring now to FIG. 5, the forearm 36 includes rail portions 23 that extend from the forearm 36 such that each of the rail portions 23 extends above the centerline of the barrel 60. Each of the rail portions 23 defines a rail interface system 92 (FIG. 1) that is monolithically formed with the tactical chassis 20 such that the tactical chassis 20 is configured to receive accessories as detailed below. Additionally or alternatively, a lower surface of the forearm 36 may define a lower rail interface system 94 configured to receive accessories. For example, the lower rail interface system 94 may receive a bipod 98 (FIG. 1). In addition, the lower rail interface system 94 may receive a foregrip (not shown)

As shown, the rail interface system 92 and the lower rail interface system 94 are M-LOK rail systems, which is a rail system that is commonly known in the art and is shaped to receive M-LOK accessories. It is also contemplated that other rail systems that are commonly known in the art may be monolithically formed in the rail portions 23 and lower portion of the forearm 36 of the tactical chassis 20 including, but not limited to, a Picitinny rail system, a KeyMod rail system, or other rail systems as will be familiar to the skilled practitioner.

Referring back to FIGS. 1-3, the modular rifle system 10 includes a pistol grip 80 that protrudes conspicuously below the action 50 of the rifle 10 to allow for a pistol style grasp in which the web of the trigger hand (between the thumb and index finger) can be placed below the top exposed portion of the trigger mechanism 40 while firing. The pistol grip 80 includes an upper portion 84 that forms an elliptical shape such that the web of the firing hand can rest comfortably below the top exposed portion of the trigger mechanism 40 and a lower portion 86 that extends proximally and downward to form an acute angle with respect to the proximal portion 21 of the tactical chassis 20. It is contemplated that the upper portion 84 of the pistol grip 80 may form different shapes to receive the web of the firing hand and that the lower portion 86 of the pistol grip 80 may protrude from the chassis 20 at any angle to allow for a pistol style grasp.

The pistol grip 80 has a proximal side 88 that is contoured to receive a palm of a firing hand. It is contemplated that the contour of the proximal side 88 may take on any shape to comfortably receive the palm of the user's hand. The pistol grip 80 has a distal side 89 that contains ridges to receive non-trigger fingers of a firing hand of an end user. It is contemplated that the ridges may take on any shape or depth to comfortably receive the non-trigger fingers. It is also contemplated that the distal side 89 of the pistol grip 80 may be smooth. The distal side 89 may include an upper end portion 87 that is contoured to sit flush with a radius of a trigger guard 42 of the trigger mechanism 40. The pistol grip 80 is secured to the tactical chassis 20 by a fastener 82 (FIG. 10) that passes through the upper end portion 87.

Figure 8:
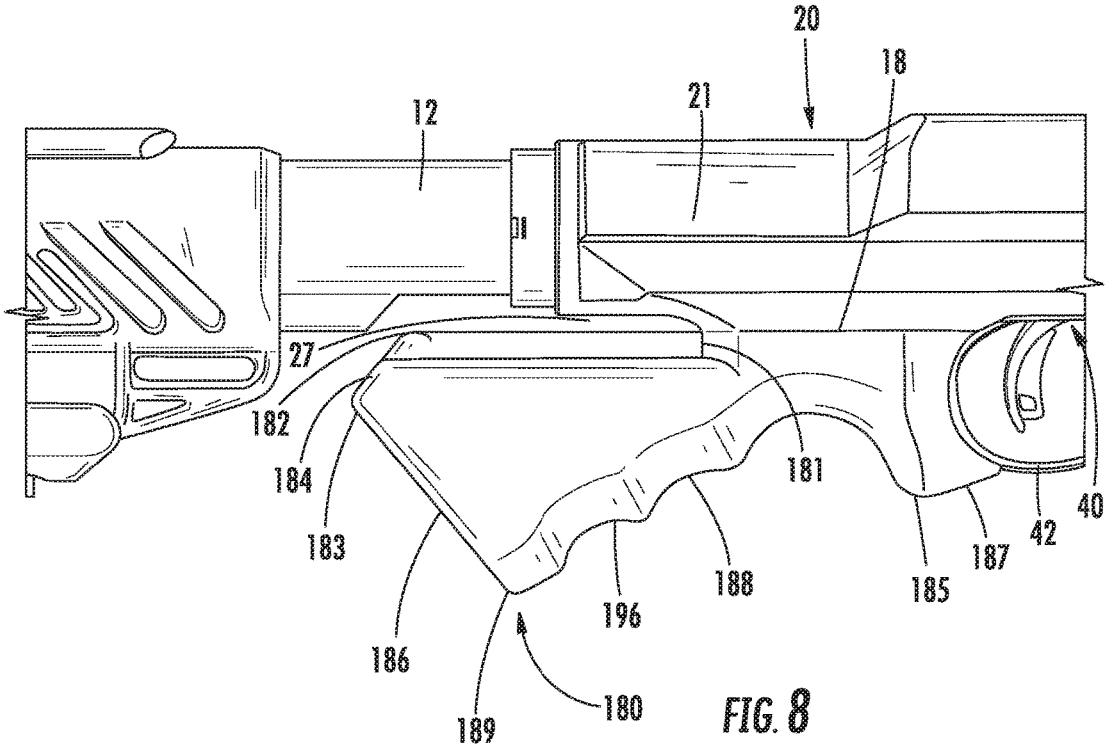
FIG. 8 is a side view of a portion of the firearm of FIG. 1 with a ridgeline grip provided in accordance with the present disclosure.
Figure 9:
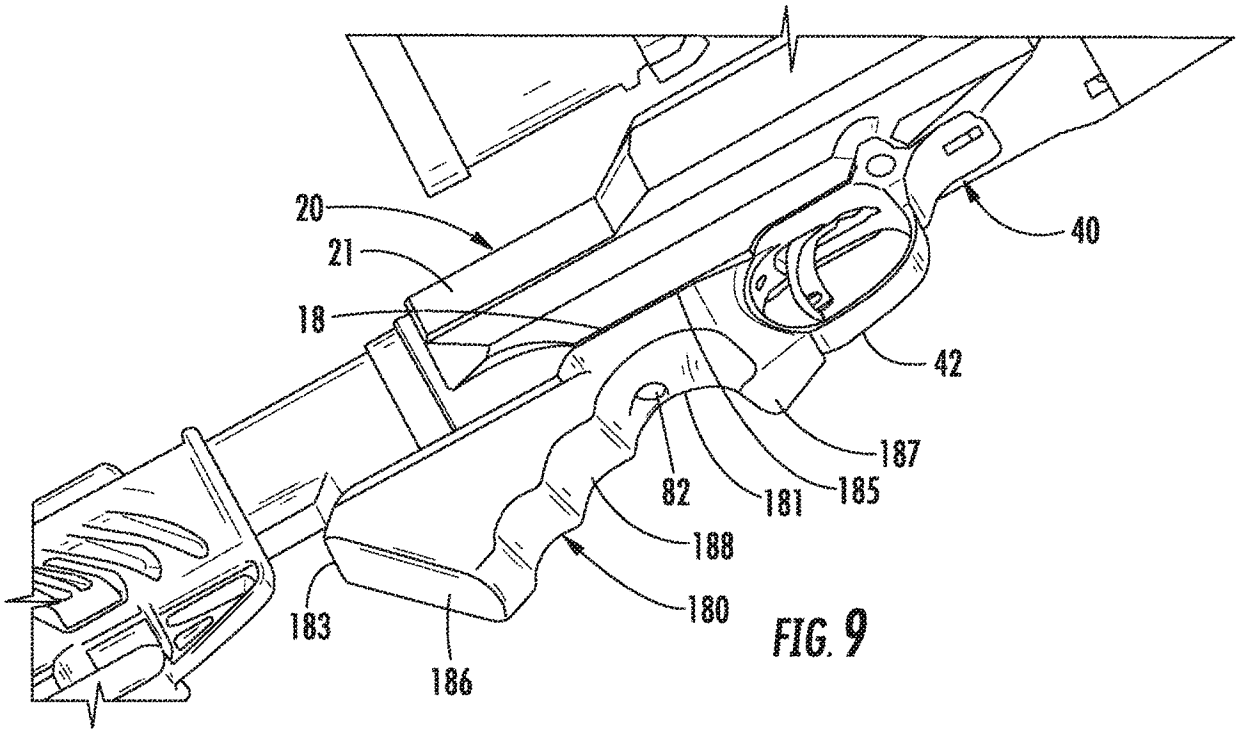
FIG. 9 is a lower perspective view of the portion of the firearm of FIG. 8.

Referring now to FIGS. 8 and 9, a ridgeline grip 180 is provided in accordance with the present disclosure. The ridgeline grip 180 is secured to a lower surface 18 of the proximal portion 21 of the tactical chassis 20 by a fastener 82 (FIG. 9). The ridgeline grip 180 includes a connecting surface 185 that is secured to the tactical chassis 20 with the fastener 82 such that the connecting surface 185 of the ridgeline grip 180 is flush with the lower surface 18 of the tactical chassis 20. When the ridgeline grip 180 is secured to the tactical chassis 20, the ridgeline grip 180 extends from the trigger guard 42 of the trigger mechanism 40 to a proximal well 27 of the proximal portion 21 of the tactical chassis 20.

The connecting surface 185 of the ridgeline grip 180 forms a corner with a proximal well wall 181 that descends a short distance to an exposed upper surface 182 of the ridgeline grip 180. The upper surface 182 of the ridgeline grip 180 extends proximally from the proximal well wall 181 beyond a proximal end of the proximal portion 21 of the tactical chassis 20 such that a portion of the upper surface 182 opposes the stock 12. As shown, a proximal tip 183 of the ridgeline grip 180 forms an angled surface 184 between the exposed upper surface 182 and a back edge 186 of the ridgeline grip 180. The backside wall 186 extends from the angled surface 184 to a lower tip 189 of the ridgeline grip 180. The angled surface 184 and the back edge 186 of the ridgeline grip 180 may meet at a variety of angles. The angled surface 184 may be a smooth curve or a plurality of surfaces to form polygonal shape when viewed from the side between the exposed upper surface 182 and the back edge 186.

The ridged face 188 of the ridgeline grip 180 extends from the lower tip 189 to a distal strut 187 of the ridgeline grip 180. The ridged face 188 of the ridgeline grip includes distinct ridges 190 to receive non-trigger fingers of a firing hand. As shown, the ridges 190 are radial in shape; however, it is contemplated that the ridges 190 may take on any shape or depth to comfortably receive non-trigger fingers. The distal strut 187 of the ridgeline grip 180 is contoured to sit flush with the trigger guard 42 of the trigger mechanism 40 such that the distal strut 187 flushingly receives the trigger guard 42.

The ridgeline grip 180 protrudes slightly below the trigger guard 42 of the modular rifle system 10 to allow for a rifle style grasp in which the web of the trigger hand can be placed above, or at the same level as, the top exposed portion of the trigger mechanism 40 during firing. The ridgeline grip 180 extends below the action to a lesser extent than the pistol grip 80 (FIG. 1) and does not allow for a pistol style grasp.

With particular reference to FIG. 9, the ridgeline grip 180 is secured to the tactical chassis 20 by the fastener 82. The fastener 82 passes through the distal strut 187 of the ridgeline grip 180 to secure the ridgeline grip 180 to the proximal portion 21 of the tactical chassis 20.

It is contemplated that a tactical chassis (e.g., tactical chassis 20) and grip (e.g., pistol grip 80 or ridgeline grip 180) may be constructed from the same material or made from different materials. Contemplated materials for the chassis and grips include, but are not limited to, natural materials (e.g. wood), man-made materials (e.g., Kevlar), composite materials (e.g., carbon fiber), metals, metal alloys, synthetic materials, laminated materials, compressed woven materials, and any combination thereof.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A chassis for a firearm, the chassis comprising:

sidewalls defining a trigger well and a magazine well therebetween, the sidewalls defining a proximal portion of a channel;

a forearm monolithically monothically formed with the chassis and extending distally from the magazine well, the forearm haying an upper side, a lower side opposite the upper side, a first side, and a second side opposite the first side, the forearm defining a distal portion of the channel in the upper side of the forearm, the channel configured to receive a barrel of a firearm; and a first rail portion monolithically formed with and extending from the forearm adjacent the channel on the first side of the chassis, the first rail portion defining part of a rail system configured to securely mount an accessory directly to the chassis.

2. The chassis according to claim 1, wherein the forearm includes a second rail portion extending from the forearm adjacent the channel on the second side of the chassis opposite the first side such that the channel passes between the first and second rail portions, wherein the first and second rail portions extend from the forearm such that an upper surface of each of the first and second rail portions is configured to extend above a centerline of a barrel received within the channel.

3. The chassis according to claim 1, wherein the sidewalls have an upper surface configured to be positioned below a centerline of a barrel received within the channel.

4. The chassis according to claim 1, wherein the lower side that defines a lower rail system is configured to securely mount an accessory directly to the chassis.

5. The chassis according to claim 1, further comprising a proximal portion extending proximally from the trigger well, the proximal portion configured to receive a stock.

6. The chassis according to claim 5, wherein the proximal portion includes a fastener configured to secure a grip to a lower surface thereof.

7. The chassis according to claim 1, further comprising a proximal portion extending proximally from the trigger well, the proximal portion integrally formed with a stock, the stock being selected from the group consisting of a fixed stock, a folding stock, and adjustable stock.

8. A method of assembling a firearm, the method comprising:

securing a barrel in a channel defined by a chassis, the chassis including sidewalls defining a proximal portion of the channel and a forearm defining a distal portion of the channel; and securing a first accessory to a first rail system of the chassis, the first rail system extending from the forearm on a first side of the channel such that an upper surface of the first rail system is positioned above a centerline of the barrel when the barrel is received within the channel, the first rail system monolithically formed with the forearm.

9. The method according to claim 8, wherein securing the first accessory includes securing the first accessory to a second rail system of the chassis, the second rail system extending from the forearm on a second side of the channel such that an upper surface of the second rail system is positioned above the centerline of the barrel when the barrel is received within the channel and the barrel is positioned between the first and second rail systems, the second rail system monolithically formed with the forearm.

10. The method according to claim 8, further comprising securing a second accessory to a lower rail system of the chassis, the lower rail system defined in a lower surface of the forearm opposite of the channel.

11. The method according to claim 8, further comprising:

positioning a trigger mechanism in a trigger well defined by the sidewalls, the trigger mechanism having a trigger guard and a trigger; and securing a ridgeline grip to a proximal portion of the chassis proximal of the trigger well such that a distal strut of the ridgeline grip receives a portion of the trigger guard, the ridgeline grip having a connector extending proximally from the distal strut and a hand grip extending proximally from the connector, the hand grip having an upper surface spaced apart from and opposed to a proximal portion of the chassis and a lower surface extending from the connector, a plane defined by the lower surface forming an acute angle with a plane defined by the upper surface, the lower surface configured to receive non-trigger fingers of a hand.

12. The method according to claim 11, wherein securing the ridgeline grip includes passing a fastener through the connector of the ridgeline grip and into the proximal portion of the chassis.

13. The method according to claim 11, further comprising securing a stock to the proximal portion of the chassis such that the upper surface of the hand grip opposes a portion of the stock.

14. A firearm comprising:

a monolithic chassis including:

sidewalls defining a trigger well and a magazine well therebetween, the sidewalls defining a proximal portion of a channel;

a forearm extending distally from the magazine well, the forearm having an upper side, a lower side opposite the upper side, a first side, and a second side opposite the first side, the forearm defining a distal portion of the channel in the upper side of the forearm; and a first rail portion extending from the forearm adjacent the channel on the first side of the chassis, the first rail portion defining part of a rail system configured to securely mount an accessory directly to the chassis;

a barrel received within the channel such that a centerline of the barrel is at or above a top surface of the sidewalls; and an action having at least a portion of the action received within the trigger well.

15. The firearm according to claim 14, wherein the forearm includes a second rail portion extending from the forearm adjacent the channel on the second side such that the channel passes between the first and second rail portions, wherein the first and second rail portions extend from the forearm such that an upper surface of each of the first and second rail portions is configured to extend above a centerline of a barrel received within the channel.

16. The firearm according to claim 14, wherein the centerline of the barrel is above the top surface of the sidewalls when the barrel is received within the channel.

17. The firearm according to claim 14, wherein the lower side that defines a lower rail system is configured to securely mount an accessory directly to the chassis.

18. The firearm according to claim 14, further comprising a stock secured to a proximal portion of the chassis that extends proximally from the trigger well.

19. The firearm according to claim 18, further comprising a grip secured to a lower surface of the proximal portion of the chassis.

* * * * *